United States Patent [19]

Asami et al.

[11] 4,120,759

[45] Oct. 17, 1978

[54] CONSTANT CURRENT DENSITY PLATING METHOD

[75] Inventors: Hiroshi Asami; Masao Kaji, both of Otsu, Japan

[73] Assignee: New Nippon Electric Company, Ltd., Osaka, Japan

[21] Appl. No.: 832,907

[22] Filed: Sep. 13, 1977

Related U.S. Application Data

[63] Continuation-in-part of Ser. No. 782,417, Mar. 29, 1977, Pat. No. 4,065,374.

[30] Foreign Application Priority Data

Aug. 10, 1976 [JP] Japan ..... 5195872

[51] Int. Cl.[2] ..... C25D 1/00; C25C 1/20; C25D 21/12; G05F 1/10

[52] U.S. Cl. ..... 204/14 R; 204/109; 204/231; 204/DIG. 7; 323/4; 324/30 R

[58] Field of Search ..... 204/228, 231, 14 R, 204/DIG. 7, 129.43, 109; 323/4; 324/30 R

[56] References Cited

U.S. PATENT DOCUMENTS

| | | | |
|---|---|---|---|
| 3,370,222 | 2/1968 | Haagen-Smit et al. | 323/4 |
| 3,627,648 | 12/1971 | Waggener | 204/231 X |
| 3,751,355 | 8/1973 | Mandroian | 204/109 X |
| 3,875,032 | 4/1975 | Thompson | 204/231 X |

FOREIGN PATENT DOCUMENTS

| | | | |
|---|---|---|---|
| 206,676 | 6/1968 | U.S.S.R. | 204/228 |

*Primary Examiner*—John H. Mack
*Assistant Examiner*—D. R. Valentine
*Attorney, Agent, or Firm*—W. G. Fasse; D. F. Gould

[57] ABSTRACT

In the present plating method the bath contains an electrolyte solution having a uniform ion concentration. A common electrode, a plating electrode and a standard electrode are arranged in the bath. A direct current source is connected between the common electrode and the plating electrode. A further, constant, direct current source is connected between the common electrode and the standard electrode. A potentiometer device is arranged for detecting resistance changes between these electrodes due to variations in the ion concentration and in the mobility of the electrolyte solution between the electrodes. A control is responsive to the potentiometer device for regulating the plating current supplied by the direct current source as a function of the potential difference detected by the potentiometer device, whereby a constant plating current density is achieved.

6 Claims, 7 Drawing Figures

CONSTANT CURRENT DENSITY PLATING METHOD

CROSS REFERENCE TO RELATED APPLICATION

This application is a continuation-in-part of our copending application Ser. No.: 782,417; filed: Mar. 29, 1977 now U.S. Pat. No. 4,065,374.

BACKGROUND OF THE INVENTION

The present invention relates to an electrolytic plating method for plating any suitable items at a constant current density. The present method is especially suitable for the so-called "bump" plating of semiconductor components.

In order to uniformly plate a large number of substances and to also control the thickness of the plating deposit of each substance, it has been proposed to carry out a plating, wherein the total current supply may be determined from the total surface area of the elements to be plated simultaneously. The total surface area is estimated from the number of elements to be plated together in a plating bath and from their configuration. For example, a plating treatment can be carried out by supplying a total electric current determined by the multiplication of an optimum plating current density under a desired plating condition, with the estimated total surface area of elements to be plated, by regulating the applied voltage and observing the total current indicated by an amperemeter. The total surface area may be estimated by multiplying the surface area of any one article to be plated with the total number of articles having the same configuration and which are to be plated simultaneously in the same bath. However, it is tedious and difficult to get the total surface area exactly if the configuration of each article is complicated and if the total number of articles in one bath is very large. Besides, with prior art devices it is difficult to exactly maintain the desired plating conditions. Hence, a uniform plating thickness has been difficult to achieve heretofore.

It is also known to treat semiconductor components of so-called Planar or Mesa type semiconductors having diffusion zones with metal on every diffusion zone, in a plating process to prepare said semiconductor zones for providing electrodes. The metallic plating treatment is intended to provide the respective semiconductor component with a hemispherical "bump" which may be easily used as an electrode means. Stated differently, the plating must be a so-called "bump" plating which may be utilized not only for the plating of the diffusion zone of a semiconductor component with metal, but also for the preparation of integrated circuit terminals. For example, in the manufacture of a Planar type diode, first windows are provided by a selective photo-etching technique on the surface of a base plate of an N-type semiconductor having a silicon dioxide covering layer. A P-type impurity is permitted to diffuse selectively through the windows to form P-type zones. In the next step, a metallic anode layer is applied which tightly contacts every P-type zone. Simultaneously, metallic cathode layers are applied to cover the back side of the base plate of N-type semiconductor material. Thereafter, a so-called silver plating is carried out at every window which is provided with the metallic anode layer. This is accomplished by dipping a plurality of N-type semiconductors into a plating bath containing an electrolytic solution and by connecting a direct electric current source with its positive pole to a silver electrode in the plating bath. The silver electrode contacts the metallic anode layers of the semiconductor components. The negative pole of the direct electric current source is connected to the metallic cathode layers of the semiconductor component, whereby the flow direction of the direct plating current is in the same direction as the normal flow direction through the semiconductor.

The just described so-called "bump" plating of semiconductor components has the disadvantage that the total plated surface area increases with the growth of the hemispherical bump configuration. Thus, it becomes substantially impossible to continue the plating process with an optimum current density if the plating is carried out with a constant voltage or if the plating is carried out with a constant total current without adjusting the actual current density per unit area to the increasing surface area being plated. As a result, it is virtually impossible to obtain a uniform plating which is strongly bonded to the supporting surface and it becomes inevitable that the plating current passes through areas which are not supposed to be plated outside the P-type diffusion zone or zones. Thus, it is possible that bare portions of the N-type base plate may be plated due to the existance of pin holes in the covering layer of silicon dioxide or the edge of the base plate may be plated. Further, the normal current through the window parts may result in various depositions of plating metal, also in these areas which are not desired to be plated. As a result, it is a serious disadvantage that short circuits may occur between the undesired plating depositions and the normal plating electrodes in the windows.

These undesirably plated areas also provide an unnecessary electrostatic capacity. Accordingly, it becomes very difficult to determine the total current necessary for maintaining optimal plating conditions by simply estimating the total surface area to be plated. As stated, the estimation becomes virtually impossible, due to the increase of the total surface area, not only by the gross of the plated electrodes of semispherical "bump" configuration, but also by the deposition of plating metal in unexpected and undesired areas.

In order to remove plating metal from the above mentioned pin holes in the insulation layer of the semiconductor component, it is also known to employ a so-called periodic reverse plating method which uses a commercial alternate current. By reversing the electric current repeatedly it becomes possible to eliminate the plating metal deposition from the pin holes and around the edge of the base plate because the plating metal in these areas is dissolved into the electrolytic solution by ionization. This is possible because the PN junction present in each window of the semiconductor component does not permit the passage of the reverse current, whereas other areas, such as the pin holes and the edge of the base plate permit the passage of the reverse current by the ionization of the plating metal accumulated during the preceding plating process. As a result, a series of periodically repeated cycles of plating and electrolysis may be used to prepare a thick plating having a hemispherical configuration. However, the plating will take place only on every area in register with a complete PN junction and having a sufficient definite rectifying ability. However, this prior art method is not suitable for plating practically any bare area, such as a pin hole which has no rectifying ability or in areas of an incomplete PN junction which do not have a normal rectifying ability.

The above described convention periodic reverse plating method does not permit the complete elimination of plating metal on surface areas which are not supposed to be plated. Moreover, it becomes very difficult to carry out the plating operation at an optimum current density since surface areas remain which cannot be taken into account. Another drawback of the periodic reverse plating method is seen in that it requires an uneconomically long period of time.

OBJECTS OF THE INVENTION

In view of the above, it is the aim of the invention to achieve the following objects, singly or in combination:

- to overcome the disadvantages of the prior art, more specifically to regulate the plating current in such a manner that the current density may always be maintained at a desired definite value, even if the surface area to be plated changes during the plating operation itself;
- to provide an improved plating method, wherein a constant current density is automatically regulated or controlled, and wherein the plating current is preferably selectively applied to the plating bath;
- to provide a method and apparatus for the so-called "bump" plating of semiconductor components;
- to control the plating current at any desired value, preferably selectively to maintain the current density constant when plating "bumps" having a hemispherical configuration;
- to control the plating current as a function of a computer programming combination with continuously checking the change of the electrical conditions in the electrolytic solution, whereby to take into account unexpected changes in the surface area that is being plated; and
- to supply a current to the electrolytic plating bath which is controlled in its strength in direct response to the increasing surface area of the surface that is being plated.

SUMMARY OF THE INVENTION

According to the invention the present method may be performed in a plating apparatus having a standard electrode connected to a constant electric current source and a pair of further electrodes connected to an electric source capable of supplying a changeable plating current to a plating bath, wherein the plating treatment is carried out at a constant current density which is regulated by utilizing the output of a detector for detecting the change of electric potential in the electrolytic solution which change is induced by a constant electric current flowing toward the standard electrode. Stated differently, in the apparatus used herein, the plating bath contains an electrolytic solution of uniform ion concentration and the first or common electrode is arranged in the bath with second electrodes which constitute the articles to be plated and with a third electrode which constitutes the standard electrode. A constant current source comprising a series arrangement of a constant voltage source and a high electric resistance is connected between the first and the third electrodes while a current control device for controlling the current from a respective electric source is connected between the first and second electrodes. A detector for detecting the change of the potential between the first and the third electrodes is part of the control device and is used to assure a constant plating current density.

According to the invention, there is further provided an improved periodic reverse plating method which is especially suitable for the so-called "bump" plating. The apparatus may be operated at an optimal current density regardless of the difference in the junction resistance of the semiconductor components to be plated. This optimum current density may be accomplished by inserting a pseudo-resistance corresponding to the junction resistance of the semiconductor, into the detection means which monitor the potential change of the standard electrode. It is a surprising and advantageous effect of the present invention that the time necessary for the improved periodic reverse plating operation is substantially reduced by employing, for the electrolysis phase, a higher voltage than for the plating phase, thus, each electrolysis phase is substantially shorter than the plating phase.

According to the invention, a periodic reverse plating process is further improved and adapted for plating Zener-type semiconductor components having a tendency to form an abnormal "bump" during the plating process. The invention modifies a periodic reverse plating method by changing the repeating cycles of plating an electrolysis in such a manner that in the initial stage of repeating cycles, the duration of the electrolysis phase is sufficiently longer than the plating phase. For example, the duration or period of the electrolysis phase may be longer only during the initial two or three cycles, as compared to the respective plating phase in order to prevent any abnormal plating on a semiconductor element or component which has a tendency to cause such abnormal plating due to its abnormal resistance relative to the applied potential.

The periodic reverse plating method, according to the invention, has a high plating efficiency and is very practical for the intended purpose as described above. Another advantage is seen in that it permits to efficiently remove the plating metal from the pin holes and around the edges of the base plate by the application of a voltage close to the critical value at which the current in the silicon diode increases rapidly. The improved method makes it possible to decrease the tedious work involved in eliminating or repairing of semiconductor elements, the plating of which does not meet the established standards, for example, because the plating metal is accumulated in a non-uniform manner. The present method also eliminates the work heretofore necessary for covering the pin holes with a resist for protection of the pin holes.

According to the invention, the plating current density is maintained constant regardless of the increase of the surface area being plated as the "bump" plating of a hemispherical configuration progresses. This is accomplished, according to the invention, by controlling the plating current by a computer program which takes into account the relationship between the surface area and a plating type previously determined by experimentation. Simultaneously, the plating current to the standard electrode is also controlled or regulated and a constant current source is employed in order to adjust or compensate for any change of current density due to surface area changes which cannot be anticipated by preliminary experiments. The change of the conductivity of the electrolytic solution is also taken into account as a control or regulating factor.

The apparatus supplies a programmed plating current which corresponds to the increase in the surface area of the "bumps" being plated. In addition, a computer program controls the periodic reverse sequence of plating and electrolysis steps, whereby a constant current ratio between the plating current and the electrolysis current is maintained while simultaneously the third or standard electrode is used for adjusting the plating condition of each semiconductor wafer. The present apparatus is especially suitable for uniformly "bump" plating of semiconductor components, such as diodes. In addition, the present apparatus is suitable for plating various kinds of semiconductor components with large differences in their junction resistance. This is possible because the present apparatus is provided with a variable resistor in the circuit of the standard electrode for detecting the electric potential in the electrolytic solution, whereby it is easily possible to regulate the current density to maintain it at a constant value.

By using an N-type base of semiconductor material as the plating electrode, it is possible to provide a plated electrode having a hemispherical "bump" configuration in every window portion on a P-type zone of a PN junction type semiconductor. Incidentally, the periodic reverse plating is carried out by employing a separate electric current source for the electrolysis and a polarity changeover device is provided for reversing the polarity of each electrode.

BRIEF FIGURE DESCRIPTION

In order that the invention may be clearly understood, it will now be described, by way of example, with reference to the accompanying drawings, wherein.

Figure 1:
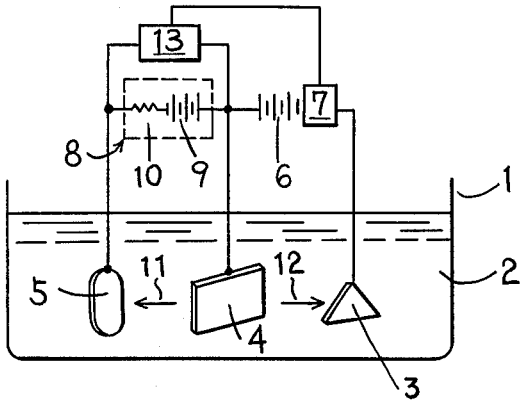
FIG. 1 illustrates a simple circuit arrangement and electrolytic bath for performing the present method.

DETAILED DESCRIPTION OF PREFERRED EXAMPLE EMBODIMENTS:

FIG. 1 illustrates the basic embodiment of an apparatus for performing the present electroplating method, for example, to provide a silver deposition. The apparatus comprises an electrolytic bath container 1 holding an electrolyte solution 2, having a uniform ion concentration. Conventional agitators and heating units may be combined with the bath if necessary. Three electrodes are employed, according to the invention, namely, a cathode plate 3 made of a substance to be plated with silver, a common anode silver plate 4 and a standard electrode 5, having a definite surface area. The standard electrode 5 has the same polarity as the cathode plate 3, which is to be plated. The cathodes are arranged at a definite position in a plating bath 1.

The present plating apparatus may be used for plating with other metals than silver, simply by changing the composition of the plating bath and the material of the anode plate. The present apparatus may further be used for the electrode position of insulating materials, such as alumina in an electrophoresis process merely by reversing the polarity of each of the above mentioned electrodes.

The standard electrode 5 is constructed, for example, of a copper plate having a surface area of $1cm^2$ to maintain the surface area as constant as possible even after the plating. The cathode electrode 3 and the anode electrode 4 are connected to the corresponding poles of an electric power source 6, connected in series with a current regulating device 7, whereby the plating current strength may be continuously changed. A constant current source 8 is connected between the anode 4 and the standard electrode 5. The constant current source 8 comprises a series connection of a constant voltage source 9 and a resistor 10. The resistor 10 is connected between the standard electrode 5 and the negative pole of the voltage soucre 9. The position pole of the voltage source 9 is connected to the anode 4.

According to the invention, the resistance value of the resistor 10 should be sufficiently larger than the resistance value of the electrolytic solution between the two electrodes 4 and 5. For example, the resistor 10 could have a value of 10KΩ. The resistor 10 in combination with the voltage source 9 provides a constant current source so that changes in the electric resistance of the electrolyte between the electrodes 4 and 5, for example, due to concentration changes in the electrolytic solution, or due to temperature changes of the electrolytic solution, or due to changes in the surface area of the cathode electrode 3, which is being plated, do not affect the strength of the current flow 11 toward the standard electrode 5. Accordingly, the strength of the current flow is maintained substantially constant.

Figure 2:
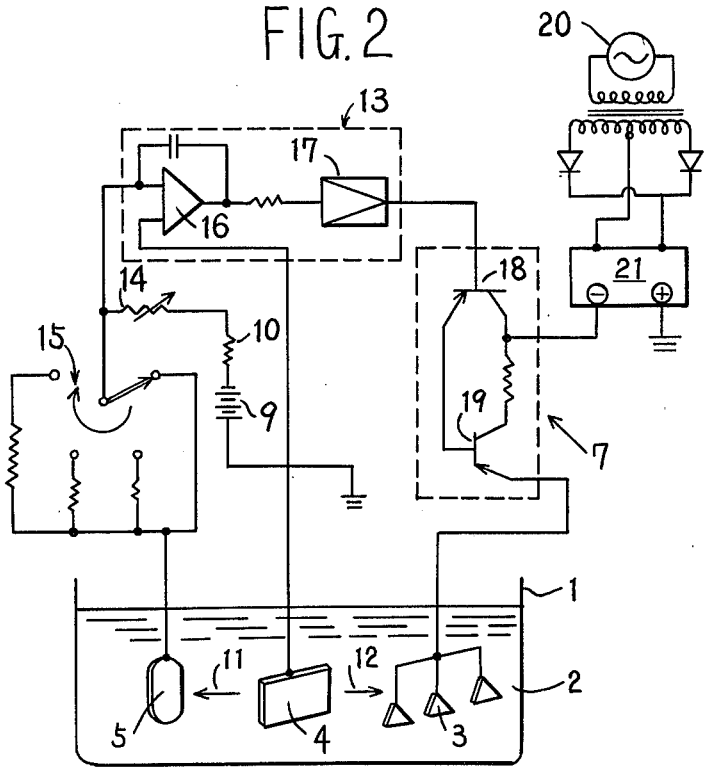
FIG. 2 is a block diagram of a practical example embodiment for realizing the basic principle illustrated in FIG. 1.

The plating current flows in the direction of the arrow 12 from the anode 4 to the cathode electrode 3, as shown in FIGS. 1 and 2. The strength of the plating current is regulated so that the desired constant plating current density is maintained, for example, by means of a regulating device 7, shown in FIG. 2, which is controlled by the output signal of a dectector circuit 13, operatively connected to monitor and detect the potential between the anode 4 and the standard electrode 5. The resistance change in the electrolytic solution between the anode 4 and the standard electrode 5 may be detected as a potential change between the electrodes 4 and 5 by the dectector 13 because a definite constant current passes through these electrodes from the constant current source 8, whereby the supply voltage of the main electric source 6 is regulated through the circuit 7. Accordingly, the plating current density is made constant during the entire plating operation.

Generally, the total current strength may be calculated by multiplying an optimal current density value with the total surface area to be plated. The total surface area may be estimated, as mentioned, from one component or element to be plated and the number of components to be simultaneously plated. However, even if the surface area to be plated increases or decreases with the progress of the plating, the strength of the total plating current does not follow exactly and proportionally to such a change. This phenomenon appears to be due to internal friction in the electrolytic solution or due to the change in the ion mobility in the electrolytic solution, which may depend on various conditions. Thus, it is impossible to carry out a conventional plating process with the optimum current density at all times. However, the present invention overcomes the just mentioned difficulties by the use of the standard electrodes 5 and the constant current source 8, including the constant voltage source 9 and the high resistance 10 as described above in combination with the potentiometer dectector 13 controlling the regulator circuit 7, which in turn controls the electric power supply source 6 for the plating operation, whereby the plating current 12 may be varied to maintain the desired constant current density.

The internal resistance of the electrolytic solution changes in response to plating current changes or rather, in reponse to the plating current density, the invention takes into account by measuring or monitoring the internal resistance in the electrolytic solution between the electrodes 4 and 5, thus, as the cathode surface area increases, the plating current 12 is also increased to obtain the desired constant plating current density as described.

FIG. 2 illustrates a block diagram of an apparatus suitable for plating a plurality of semiconductor wafers. Each wafer 3 has a diameter of 50mm and supports about 16,000 pellet elements. According to the invention, a silver plating of hemispherical "bump" configuration having a height of about 45$\mu$ is provided in each window of the wafers which windows have a diameter of about 125$\mu$.

Between the electrodes 4 and 5 again the constant current source is connected including the voltage source 9 and the series resistor 10 and further modified with an additional variable series resistor 14 and a resistor selector device 15. With the aid of the variable resistor 14 the density of the constant current 11 is adjusted to be equal to the plating current 12, that is, the constant current 11 is adjusted to be equal to the optimal plating current density, for example, 43 mA/cm$^2$. The potentiometer 14 is also used for the current adjustment, for example, when one standard electrode 5 having a given surface area, for example, of 1 cm$^2$ is replaced by another standard electrode having a different surface area. The resistor selector switch device 15 makes it possible to connect in series with the just described elements of the constant current source, further resistor means of differing values, whereby a proper resistance equivalent for the junction resistance of the semiconductor components 3 may be provided between the standard electrode 5 and the constant current source 8. A resistance of the device 15 will be part of the circuit whenever the semiconductor wafers have a junction resistance. However, where semiconductors are plated having no junction resistance, the switch member of the device 15 will be shown in the illustrated position bypassing the resistors of the device.

As mentioned above, the conductivity or rather, the internal resistance of the electrolytic solution 2, changes as a function of the surface area of the wafer 3, as a function of time, and as a function of temperature variations, as well as other factors. The anode 4 and the standard electrode plate 5 have a definite spacing from each other. However, the resistance of the electrolyte solution between these electrodes 4 and 5 also changes in response to the above mentioned factors and the change in potential difference between these electrodes is detected by the detecting device 13. The detection device 13 comprises an operational amplifier 16 and an amplifier 17. The output of the detector 13 is transmitted to the current regulating circuit 7 comprising two transistors 18 and 19, connected to form a variable impedance circuit. A constant voltage source 21, as shown in FIG. 2 is connected to the regulating circuit 7. In order to supply a direct, constant voltage to the regulating circuit 7, the output of an alternating current source 20 is rectified. The output of the amplifier 17 is connected to the base of the transistor 18. The emitter of the transistor 18 is connected to the base of the transistor 19. One output terminal of the constant voltage electric source 21 is connected to each collector of the transistors 18 and 19. The other terminal of the source 21 is grounded. Thus, the electric plating current circuit forms a closed control loop, wherein the plating current flows from the anode 4 into the wafers 3 through the emitter of the transistor 19, as shown in FIG. 2.

As mentioned, according to the invention, the plating current is varied in the closed loop control circuit so that it is exactly proportional to the change in surface area. The varying of the plating current or maintaining the current density constant is accomplished, according to the invention, in that the operational amplifier 16 detects the change in potential difference between the anode plate 4 and the standard electrode 5. The amplified output of the amplifier 16 is applied to the variable impedance control circuit 7, whereby the plating current 12 from the constant voltage source 21 may be regulated by the variable impedance circuit 7. The plating current 12 is regulated so as to increase in correspondence to the increase of the electric resistance of the electrolytic solution 2 as detected by the circuit 13 as an increase in the potential difference between the anode 4 and the standard electrode 5. The present plating apparatus is especially useful in the entire plating field and may be employed for plating articles of any shape and/or number, whereby a large number of components, such as semiconductor components may be plated simultaneously.

Figure 3:
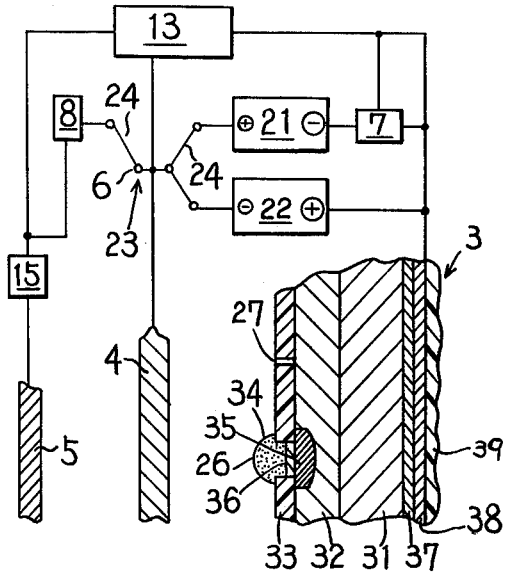
FIG. 3 is a block diagram showing the electrical circuit arrangement of another example embodiment of a plating apparatus according to the present invention which is especially suitable for the so-called "bump" plating of semiconductor components.
Figure 4:
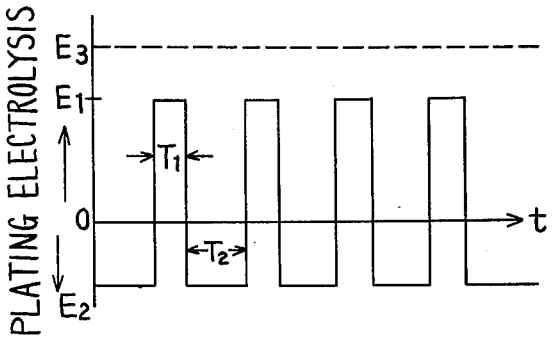
FIG. 4 shows the voltage wave form for the plating and the electrolysis in a periodic reverse plating method carried out in an apparatus as shown in FIG. 3.

FIG. 3 shows a block diagram of another example embodiment, according to the present invention, employing a periodic reverse plating method, wherein the plating phase and the electrolysis phase alternate with each other as shown in FIG. 4, which will be described in more detail below. In FIG. 3 the wafer 3 is illustrated on an enlarged scale. The wafer 3 comprises a base plate 31, for example, of N$^+$ silicon supporting a layer 32 of N$^-$ silicon. The layer 32 is formed by epitaxial growth. An insulating covering layer 33 of silicon dioxide is formed on the layer 32 and provided with windows 34. The windows may be formed by photoetching techniques well known in the art. P-type zones 35 are formed by diffusion of a P-type impurity into the N$^-$ silicon layer 32 through the windows 34. A metallic layer 36 of positive polarity is prepared on every P-type zone 35 in order to assure a sufficiently strong bonding between the zone 35 and the respective "bump" to be provided in the window areas by the plating. On the back of the N$^+$ silicon base plate 31, a layer of gold 37 and a layer of silver 38 are applied by a plating process to form a metallic cathode layer. A protecting insulating layer 39 covers the silver layer 38. The protective insulating layer 30 may, for instance, be a "apiezone"

wax. A conductive connector, such as a clip, is secured to the metal layers 37, 38 for supplying the plating current. However, the connector itself and the area to which the connector is secured are also protected, for example, with such a wax prior to dipping the wafer into the electrolytic solution for the plating operation.

Referring further to FIG. 3, the wafers are inserted into a bath with the above mentioned electrodes 4 and 5. A direct constant voltage source 21 is connected between the connector clip (not shown) and a polarity change switch 23, having contact arms 24. The source 21 is operable during the plating phase. A further source 22 is also connected as just described, and is operable during the electrolysis phase. The changeover device or polarity reversing switch 23 makes it possible to alternately use these supplies 21, 22 for definite periodic cycles. The changeover device 23 is constructed to also disconnect the constant current source 8 in a periodic manner as shown in FIG. 3. The constant current source 8 is the same as described above, with reference to FIG. 2 and may also be connected through a resistor switching device 15. The detector 13 and the regulating device 7 are also the same in FIG. 3 as in FIG. 2. During the plating phase of a cycle, the anode plate 4 is connected to the constant current source 8 and to the source 21, just as in FIG. 2. Thus, a normal plating may be carried out with a constant plating current density. During the electrolysis the constant current source 8 is switched off and the standard electrode 5 is in a free state, so to speak. The electric source 22 is connected between the wafer 3 and the electrode 4 during the electrolysis cycle.

It is an advantage of the method according to the invention, that plating metal deposited on the surface of the standard electrode 5 may be removed during the electrolysis phase of each repeating cycle of operation. To this end, a polarity reversing switching means would be connected to the standard electrode to reverse the polarity of the constant current source 8, in the same manner as is done on the wafer side.

The polarity changer 23 is controlled by a timer to achieve the voltage application as illustrated in FIG. 4. The positive potential $E_1$ is applied during the electrolysis phase. The negative potential $E_2$ is applied during the plating phase of each cycle. The positive potential $E_1$ should be smaller than the continuous reverse potential $E_3$ of the semiconductor. Preferably, the duration of the phase $T_1$ is shorter than the duration of the phase $T_2$. Thus, the present invention makes it possible to shorten the total time necessary for the plating operation. It has been found that time reductions of 33 to 50% have been accomplished according to the invention as compared to the time period required by conventional periodic reverse plating method which employ a commercial alternating current source. The positive potential $E_1$ should not be higher than the continuous reverse potential $E_3$ in order to avoid the destruction of the PN junction.

Referring to FIG. 4, the first step is a plating step with the application of the negative $E_2$ potential. In the plating operation, the positive electrolysis potential $E_1$ was about $^{+}2V$ and the negative plating potential $E_2$ was about $^{-}0.5V$ at the beginning and about $^{-}0.7V$ at the completion or last phase of the plating operation. The time duration $T_1$ was about 30 sec. and the plating time $T_2$ was about 60 sec. In one practical example the plating was continuing for 30 min. under the just mentioned conditions, whereby hemispherical "bump" configurations 26, as shown in FIG. 3 and having a height of 40μ were produced. As a result of the invention, the existing pin holes 27 in the insulating layer 33, did not show any plating metal deposits. Similarly, no plating metal deposits were found to adhere to the edges of the base plate. Another advantage is seen in the fact that the plated electrode 26 of hemispherical "bump" configuration had a dense and hard surface and was intimately bonded to the metal surface 36. In addition, the electrode 26 had a sufficient lustre. Furthermore, no plating metal deposits could be found in any locations where such deposits are not desired. These advantages are achieved by the potential difference of about 0.2V between the initial and final plating voltages, whereby the effect of the standard electrode 5, according to the invention, is evident.

If it should become necessary to emphasize the prevention of undesired plating deposits, it is suggested, according to the invention, to increase the duration of the electrolysis period in the initial phase of repeating cycles. For example, the electrolysis phase of 60 sec. and the plating phase of 30 sec. which are suitable for preventing any abnormal deposition of plating metal in the manufacture of semiconductor components, such as double heatsink diodes, could be modified, thus, a first electrolysis step of 300 sec. could be succeeded by repeated cycles of 60 sec. plating phases alternating with 30 sec. electrolysis phases. In another example, the plating phases could be 30 sec. each in two cycles and the electrolysis phase could be 300 sec. followed by repeating cycles of 60 sec. plating steps and 30 sec. electrolysis steps.

The first example of 30 sec. of electrolysis alternating with 60 sec. of plating and also the second method are especially effective to prevent abnormal depositions in semiconductor components of the Zener type, whereby electrolysis is carried out as the first step, the length or duration of which may be adapted to the particular requirements.

Figure 5:
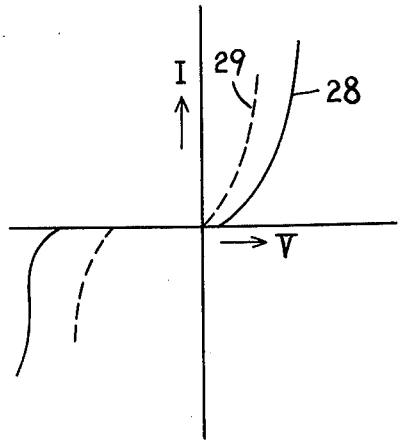
FIG. 5 illustrates the current voltage characteristic of semiconductor components of the Zener-type, two of which are arranged, for example, on one wafer.

Generally, normal elements or pellets coexist with abnormal elements on the same wafer 3. The normal elements show a current voltage characteristic 28. The abnormal elements show a current characteristic 29 as illustrated in FIG. 5. The present invention removes the spattered metal layer 36 from the abnormal elements. If the metal layer 36 is missing and hence does not form a positive pole on any pellet, it is not possible to plate such a pellet. Thus, to be most effective, the present invention uses an electric voltage source for the electrolysis, the voltage of which is higher than the continuous reverse potential of pellets which do not meet the minimum standard.

The third example given above, wherein the first short plating step is followed by an electrolysis step of longer duration, followed in turn by a shorter plating phase or duration, illustrates a further improved method of repeating different cycles of operation, which may be repeated for two or several times, whereafter, normal periodic cycles are carried out. It is the advantage of this particular method to prevent the decrease of the thickness of the spattered metallic layer 36 on the normal pellets during the removal of the layer 36 on abnormal pellets.

The present apparatus may comprise means for measuring the electric resistance of the electrolytic solution between the electrodes prior to starting a plating process to provide information whether or not it is necessary to exchange the electrolytic solution. A visible or audible indication may be given. The present apparatus is especially suitable for plating various articles, elements, and components such as semiconductors having differing junction resistances. As mentioned, the resistor switching device 15 is used to provide a resistance equivalent to the junction reistance of the semiconductor being plated. If no junction resistance is involved, the resistors of the device 15 are short circuited or bypassed. This is the case, for example, when "bump" plating integrated circuits.

The invention also teaches the control of the plating current in response to a previously established program, which takes into account emperically estimated surface area increases. In this embodiment, the standard electrode 5 is used to adjust the current strength in response to the change of plating conditions relative to the initial condition. This control also takes into account any accidental damage to the semiconductor wafer. On the other hand, the change of the plating current, due to an increase in the surface area of the electrodes being plated, and having a hemispherical configuration in response to the progress of the "bump" plating, is adjusted by means of a previously established computer program which controls the plating progress. However, it is preferred to regulate the plating current through the standard electrode 5 in response to said previously established computer program and to selectively supply the regulated plating current to the plating bath in such a manner that a predetermined plating condition, such as the ion concentration or current density is maintained throughout the plating operation.

Figure 6:
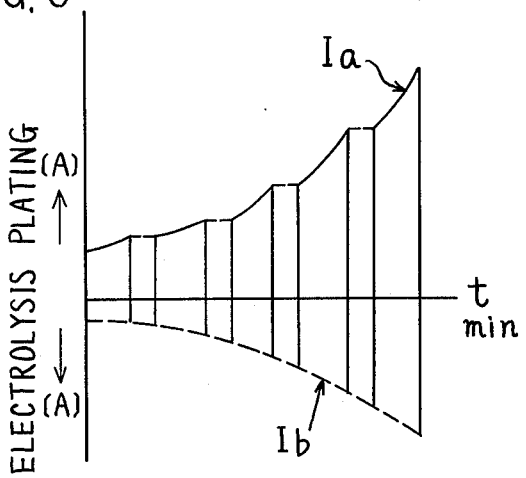
FIG. 6 illustrates a characteristic current change in practicing "bump" plating in a periodic reverse plating process which is program controlled, and wherein the ratio between the electrolysis current and the plating current is constant.

FIG. 6 illustrates an example of the change of the plating current and of the electrolysis concurrent in response to a computer program. For example, where a planar type diode is "bump" plated with silver, the surface area "S" or rather, the surface area increase may be expressed by an equation of the second order as follows:

$$S = at^2 + bt + c$$

wherein $t$ is the time duration of the plating and wherein $a$, $b$, and $c$ are constants which determine or represent the plating conditions.

On the other hand, the total current strength "I" necessary to carry out the plating operation at an optimal current density "K" is determined as follows:

$$I = KS = At^2 + Bt + C$$

wherein A, B and C are also constant determined by the plating condition. Accordingly, the total plating current "I" should be increased in accordance with the functions set forth by the above relationship and as shown, by the curve "I*a*" in FIG. 6.

With regard to the periodic reverse plating method described above with reference to FIG. 3, it was found that it is advantageous for a satisfactory plating operation to keep the ratio of the electrolysis current to the plating current constant. Therefore, it is advantageous and necessary for a uniform plating to supply an electrolysis current "I*b*", as shown in FIG. 6, which is proportional to the plating current "I*a*" at all times. These currents, or rather, the strength thereof, may be estimated from the above equasions. Therefore, it is possible to supply such currents by using a computer program which is effective to control the power supply circuit of the plating apparatus. In the following example, the simultaneous plating of twenty sheets of wafers 3 will be considered, whereby each wafer comprises 16,000 pellets and has a diameter of 50mm. The current strength "I" necessary for continuing the plating operation at a constant current density after "$t$" minutes of plating time is determined by the following equation:

$$I = K\,(7t^2 + 5rt + 0.8r^2) \cdot 10^{-8} \cdot 16{,}000 \cdot 20 \text{ (mA)}$$

In this equation, each window in the wafer has a diameter "$r$" given in microns. The plated hemispherical "bump" electrode has a height "$h$" also given in microns. In the foregoing equation "K" is the optimal current density given in mA/cm$^2$. In the present example this value may be 43 mA/cm$^2$ when the growth of the height "$h$" of the plated electrode is just one micron per minute. A practical value of the diameter "$r$" is 125$\mu$ and 45 minutes are necessary for the plating time "$t$" to plate electrodes having a height "$h$" of 45$\mu$. By inserting these example values in the foregoing equation, the total current "I" may easily be estimated. Where the plating conditions, for example, in a periodic reverse plating operation, involves 60 sec. of plating and 30 sec. of electrolysis, the ratio of the two periods would be 2:1, representing an example plating condition.

According to the invention, conventional electrolytic solutions may be employed. Further, the surface area of the windows will have increased 4.4 times at the end of the 45 minutes of plating operation, as compared to the surface area at the beginning of the plating operation. This may be shown by a simple calculation using the above equation. In order to obtain a uniform ion concentration in the electrolytic solution, the present apparatus may be provided with heating and agitation devices for the electrolytic solution. A uniform ion concentration helps to regulate or control the plating current accurately.

Figure 7:
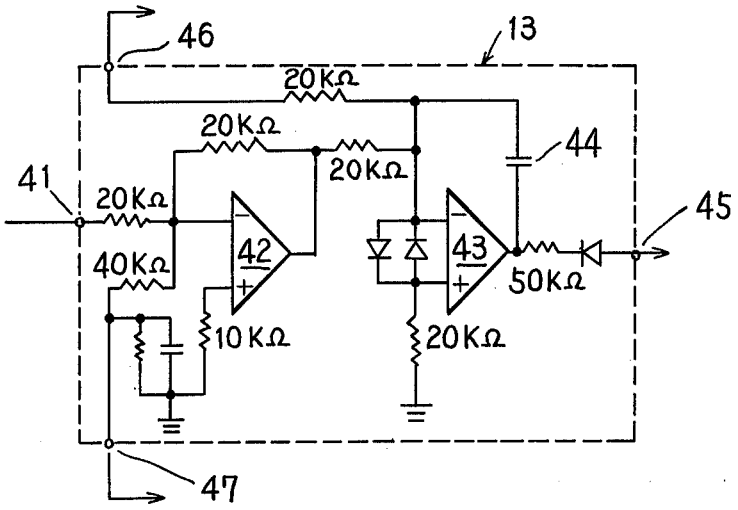
FIG. 7 shows a practical electric circuit embodiment of a potentiometer detector as shown in FIG. 3.

FIG. 7 shows a practical circuit arrangement for the detector 13 as used in FIG. 3. The detected signal is supplied to the input terminal 41 connected to the standard electrode 5. The output 45 of the detector 13 is connected to the current regulating device 7. Two operational amplifiers 42 and 43 and an integrating capacitor 44 are part of the detector circuit. A terminal 46 is connected to the wafer 3 which is being plated and a further terminal 47 is connected to detect the period of electrolysis in response to the operation of the changeover device 23, shown in FIG. 4. The arrangement is such, that any malfunction will also be detected by the detector 13. The potential detection is prevented during the electrolysis period or phase. Furthermore, the present apparatus may comprise digital means for setting the current density, as well as means for checking the electrolytic solution and alarm means for indicating a malfunction or emergency. Further indicator means may be provided for displaying the progress of the plating operation.

Although the invention has been described with reference to specific example embodiments, it will be appreciated, that it is intended to cover all modifications and equivalents within the scope of the appended claims.

What is claimed is:

1. A plating method comprising starting out with an electrolytic solution of uniform ion concentration in a plating bath, detecting the change in the electric resistance in said electrolytic solution between a standard or reference electrode and a constant current source, to produce a control output signal representing said resistance change, regulating the plating current in response to said control output signal to maintain a constant plating current density in said plating bath, interrupting the plating by repeated electrolysis steps which alternate with plating steps, applying during the electrolysis steps a voltage to the bath which is higher than the plating voltage, and setting the duration of the electrolysis steps to be shorter than the duration of the plating steps, whereby the piling-up of plating metal in places not supposed to be plated, is prevented.

2. The method of claim 1, further comprising preparing a computer program which takes into account the increase in plated surface area as the plating progresses, and regulating the plating current in response to said computer program to maintain said current density constant throughout a plating operation.

3. The method of claim 2, further comprising monitoring changes in the plating conditions and selectively supplying the regulated plating current to said plating bath in response to said changes.

4. The method of claim 3, wherein said plating current is regulated by a computer program through said standard or reference electrode.

5. A plating method comprising starting out with an electrolytic solution of uniform ion concentration in a plating bath, detecting the change in the electric resistance in said electrolytic solution between a standard or reference electrode and a constant current source, to produce a control output signal representing said resistance change, regulating the plating current in response to said control output signal to maintain a constant plating current density in said plating bath, preparing a computer program which takes into account the increase in plated surface area as the plating progresses, and regulating the plating current in response to said computer program to maintain said current density constant throughout a plating operation.

6. A plating method comprising the following steps: starting with an electrolytic solution of uniform ion concentration in a plating bath, using a constant current source connected between a single anode and a standard electrode for detecting changes in the resistance in the electrolyte solution due to changes in the surface area being plated, producing a control output signal in response to said resistance changes, and regulating the plating current in response to said control output signal whereby the plating current density is maintained constant regardless of any increase in the surface area being plated.

* * * * *